US005844488A

United States Patent [19]

Musick

[11] Patent Number: 5,844,488

[45] Date of Patent: Dec. 1, 1998

[54] BED SENSOR AND ALARM

[76] Inventor: Jeff L. Musick, 4042 E. 52nd Pl., Tulsa, Okla. 74135

[21] Appl. No.: 936,938

[22] Filed: Sep. 23, 1997

[51] Int. Cl.[6] ..... G08B 23/00

[52] U.S. Cl. ..... 340/573; 340/286.07; 340/575; 340/666; 340/686

[58] Field of Search ..... 340/285.07, 573, 340/686, 665, 666, 575, 507, 529

[56] References Cited

U.S. PATENT DOCUMENTS

| | | | |
|---|---|---|---|
| 4,633,237 | 12/1986 | Tucknott et al. | 340/573 |
| 4,907,845 | 3/1990 | Wood . | |
| 4,990,887 | 2/1991 | Lee | 340/479 |
| 5,144,284 | 9/1992 | Hammett | 340/573 |
| 5,184,112 | 2/1993 | Gusakov . | |
| 5,235,319 | 8/1993 | Hill et al. | 340/573 |
| 5,276,432 | 1/1994 | Travis . | |
| 5,353,012 | 10/1994 | Barham et al. | 340/573 |
| 5,448,996 | 9/1995 | Bellin et al. . | |
| 5,519,380 | 5/1996 | Edwards . | |
| 5,633,627 | 5/1997 | Newham | 340/573 |
| 5,654,694 | 8/1997 | Newham | 340/573 |

*Primary Examiner*—Nina Tong

*Attorney, Agent, or Firm*—Terrance L. Siemens

[57] ABSTRACT

A narrow, pressure-sensitive sensor pad for installation on top of and across the width of a mattress proximate the midsection of a reclining patient has both central and edge switching areas. The central pressure sensitive switch indicates the presence of a patient in the center of the bed. When a patient moves toward either edge of the bed, an edge switch is activated which generates an early warning signal indicating to attending personnel that a patient has moved from the center of the bed to an edge and may be attempting to exit the bed unattended. This early warning signal provides time for an attendant to reach the patient before he or she has actually evacuated the bed. In addition, the in-room alarm may remind a patient previously instructed not to leave the bed unassisted. The system prevents falls of dizzy or disoriented patients attempting to exit the bed without assistance. An optional adapter is provided to allow the inventive sensor to be connected to conventional hospital fall-prevention monitoring systems. In addition, a sophisticated, self-contained monitor system specifically adapted for use with the inventive sensor is provided. Visual and audible alerts indicate change of operational status or provide an alarm indication. Relay contacts having selectable output closure modes are also provided allowing easy attachment of the monitor to a typical nurse call system.

10 Claims, 8 Drawing Sheets

BED SENSOR AND ALARM

FIELD OF THE INVENTION

The present invention relates to a bed egress alarm system and, more particularly to an early warning bed egress alarm system designed to allow an attendant to reach a patient bed before the patient can evacuate the bed thereby preventing falls and other accidents.

BACKGROUND OF THE INVENTION

In hospitals, long-term care facilities or nursing or convalescence facilities, there is a constant possibility of a bed-ridden patient exiting his or her bed unassisted. Often a patient may become disoriented or dizzy and fall unless an attendant is present to assist the patient. Alarm systems, often for use in conjunction with a nurse call system, have been used for some time to alert a nurse, aid, or other attendant that a person has evacuated a bed. Unfortunately, by the time these conventional "after the fact" systems sound an alarm, the patient has already left the bed and may already have fallen or otherwise injured himself. Similar hazards apply to certain patients seated in chairs. Alarm systems may be designed to identify patients who have stood up and may have fallen from the chair.

DISCUSSION OF THE PRIOR ART

Several bed egress alarm sensors and systems have been patented. For example, U.S. Pat. No. 4,907,845 for BED PATIENT MONITORING SYSTEM; was issued Mar. 13, 1990 to Ron Wood. Wood utilizes a plurality of environmentally sealed ribbon switches sandwiched between stiff plexiglass sheets, the entire assembly then being disposed beneath a patient's mattress. The sensing system is used in cooperation with a normal nurse call function to provide an alarm signal when patient motion indicates bed egress. The Wood system is activated or deactivated by a switch on a bed rail. In contradistinction, the inventive sensor is designed for easy placement atop a patent's mattress and may be easily positioned by a single attendant. Unlike the Wood sensor, the inventive sensor is designed particularly for the early detection of patent motion indicating potential bed egress, thus allowing an attendant time to reach a patient before actual egress is accomplished. By means of an optional adapter, the inventive sensor may also be connected to a normal (i.e., a system expecting a normally closed (n/c) contact), fall monitoring or nurse call system while maintaining the early warning, edge sensing feature.

U.S. Pat. No. 5,144,284 for PATIENT-MONITORING BED COVERING DEVICE; issued Sep. 1, 1992 to Rawlings H. Hammett discloses a fitted, waterproof sheet structure with a plurality of both pressure and liquid sensors. Unlike the universal applicability of the inventive sensor, the Hammett structure is designed to fit only a single-size mattress. While the inventive sensor is nominally the width of a hospital mattress, its flexible construction and attachment features allow more flexibility in adapting the sensor to variety of environments. The inventive sensor may readily be manufactured in sizes to optimally function with a variety of mattress widths. In addition, although Hammett discloses a plurality of sensors, the device is incapable of differentiating between movements of the patent within the bed (e.g., rolling over) and movements indicating possible bed egress. In contradistinction, the inventive early warning sensor and alarm system is designed to differentiate such intra-bed movements from bed egress activities. The inventive sensor forms a single strip generally placed across the width of a mattress. This allows easier placement of the sensor under the hips of a reclining patient by a single attendant. Placement of the Hammett sensor requires the equivalent of changing the entire bottom bed sheet.

Another implementation of a bed egress monitor is taught in U.S. Pat. No. 5,184,112 for BED PATIENT POSITION MONITOR; issued Feb. 2, 1993 to Ignaty Gusakov. The Gusakov system features a pad with fluid-filled tubes connected to an external fluid source and, selectively, to external pressure sensors. Patient movement causes a pressure change in one or more of the fluid-filled tube which is sensed by the pressure transducers and translated into an alarm signal. Unlike the sensor of the instant invention, the Gusakov pad must be large enough to cover a significant portion of the patients mattress. The fluid-filled tubes are susceptible to damage and relatively expensive to manufacture. Also, the necessary external fluid supply apparatus and pressure sensors are both bulky and expensive. The inventive sensor, on the other hand, comprises a single, narrow band for installation under a patient's hip region atop the mattress with no fluid tubes or external pressure transducers. The inventive sensor is less expensive to manufacture and far less susceptible to damage than the sensor taught by Gusakov.

Yet another bed egress alarm system is described in U.S. Pat. No. 5,276,432 for PATIENT EXIT DETECTION MECHANISM FOR HOSPITAL BED; issued Jan. 4, 1994 to Stephen C. Travis. The Travis apparatus uses load cells at the four corners of a mattress-supporting frame to "weigh" the mattress, bedding and patient and to determine a center of gravity. In the event that a patient moves significantly towards the edge of the bed or actually evacuates the bed, the weights sensed by the four load cells change and, if the new calculated center of gravity is outside an acceptable range, an alarm signal is generated. In contradistinction, the inventive sensor system requires no expensive load cells and requires no calibration. No analog-to-digital convertors or microprocessors are required for the proper operation of the inventive system.

Yet another approach is disclosed in U.S. Pat. No. 5,353,012 for BED POSITION AND ACTIVITY SENSING APPARATUS; issued Oct. 4, 1994 to Russel Barham, et al. Barham, et al. utilize an elongated, pressure-sensitive variable resistor deployed along one axis of a mattress. Patient motion causes a resistance change which causes a current change which is sensed and compared. An excessive current change generates an alarm signal. Unlike the inventive system, the Barham, et al. apparatus is capable of generating the same current flow change from a wide variety of patient activities. Consequently, if the comparison threshold is sensitive enough to detect bed egress, it is probable that other non-egress patient motions could also generate an alarm. The early warning sensor and monitoring system of the present invention is specifically designed to reliably detect bed egress in progress so that an attendant may reach the patient before he or she has actually exited the bed. Barham, et al. can not accomplish this early warning function of the inventive sensor/monitor system.

U.S. Pat. No. 5,448,996 for PATIENT MONITORING SHEETS; issued Sep. 12, 1995 to Howard T. Bellin discloses a multi-purpose, plural sensor sheet for deployment under a patient. A piezo-electric film is bonded within a sheet for generating a variety of signals from such diverse sources as heart beats, respiration, as well as patient movement. Buffer and summing amplifiers and filters perform analog signal conditioning before the generated signals are applied to an analog signal processing system. The Bellin system requires an expensive and relatively fragile sensor structure. In addition, sophisticated signal processing equipment is required to acquire and identify the signals originating from the patient. The system must have high sensitivity to detect respiration and heart beat signals. Such a sensitive system is susceptible to both mechanical and electrical interference and well as being relatively expensive to manufacture. In contradistinction, the inventive system is a single-purpose system designed for low-cost, effective, detection of pre-egress patient movements. It is easy to install and is unaffected by ambient electrical or magnetic fields. Neither does it require any electrical calibration or adjustment, thereby making it easily installed and operated by non-technical personnel.

Finally, U.S. Pat. No. 5,519,380 for PERSONAL MONITORING SYSTEM AND METHOD; issued May 21, 1996 to Donald A. Edwards teaches a bed-evacuation alarm system relying on a radio frequency (rf) field encompassing a designated volume in the vicinity of the bed. The monitored patient is required to wear an ankle bracelet or some similar article which may be detected by the rf monitoring system. Unlike the Edwards system, the inventive bed egress alarm system requires no rf transmitters or receivers. Nor does it require the attachment of any article or device to a patient's body. The low cost of the inventive system and its ease of installation and use readily differentiate it from the Edwards system. Most particularly, Edwards has no way to provide early warning of impending bed egress as does the inventive, early warning sensor and system.

It is therefore an object of the invention to provide a low-cost, easy to install patient monitoring sensor.

It is another object of the invention to provide a sensor capable of providing an early warning signal as a patient prepares to evacuate a bed, e.g., sits near the side of the bed or puts a leg out between the bed rails.

It is a still further object of the invention to provide a patient monitoring system requiring no set-up, calibration or tuning which could require a skilled technician.

It is yet another object of the invention to provide a sensor that is essentially unaffected by ambient electrical or magnetic fields.

It is another object of the invention to provide an early-warning sensor readily adapted for use with existing fall prevention monitors while maintaining the unique, early warning edge sensing feature.

It is a further object of the invention to provide a sensor easily installed atop a patients mattress, under the hips of a reclining patient, by one attendant without unduly disturbing the patient.

It is another object of the invention to provide a sensor structure easily anchored to the bed frame using self-contained fasteners.

It is an additional object of the invention to provide a self-contained monitoring system specifically adapted for use with the inventive edge sensing sensor.

It is another object of the invention to provide a monitoring system with a single-button control for alternately arming and disabling the bed egress monitoring function.

It is yet another object of the invention to provide a monitoring system with both visual and audible alerts to indicate operational status and to provide warning that a patient is about to leave his bed.

It is a still further object of the invention to provide a monitoring system with selectable modes of operation allowing universal attachment to existing fall prevention monitors/patient alarm system regardless of the switching requirement of a particular fall prevention monitor.

It is a final object of the invention to provide a sensor system adaptable to monitoring the presence of a seated patient in a chair.

SUMMARY OF THE INVENTION

The present invention features a narrow, pressure-sensitive sensor pad for installation on top of and across the width of a mattress proximate the midsection of a reclining patient. A central pressure sensitive switch region indicates the presence of a patient in the center of the bed. Patient movement toward either edge of the bed activates a second sensor at each end of the pad which generates an early warning signal to attending personnel that a patient has moved from the center of the bed to an edge. This early warning signal provides time for an attendant to reach the patient before he or she has actually evacuated the bed. The system should prevent falls of dizzy or disoriented patients attempting to exit the bed without assistance. Converter/adapter circuitry is provided to adapt the inventive sensor to conventional hospital fall prevention monitoring systems. In addition, a sophisticated, self-contained monitor system specifically adapted for use with the inventive sensor is provided. Visual and audible alerts indicate change of operational status or provide an alarm indication. Relay contacts having selectable output closure modes are also provided allowing easy attachment of the monitor to a typical nurse call system. The monitoring system features two built-in time delay circuits. The first time delay allows a patient to briefly (i.e., one to five seconds) leave the sensor without generating an alarm. This time delay is adjustable by the attendant and may be adjusted to be responsive to the behavior characteristics of individual patients. A pre-set, backup setting of approximately eight seconds provides fault-sensitive fail-safe function in the event that the selectable time delay fails to properly function. A second time delay circuit is used to override the alarm system while either putting a patient into the bed or getting the patient out of bed. This also prevents false alarms during these patient transition times.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

Generally speaking this invention relates to a bed occupancy monitoring and, more particularly to an early-warning bed egress alarm designed to summon nursing staff before a patient can actually leave the bed.

Figure 1:
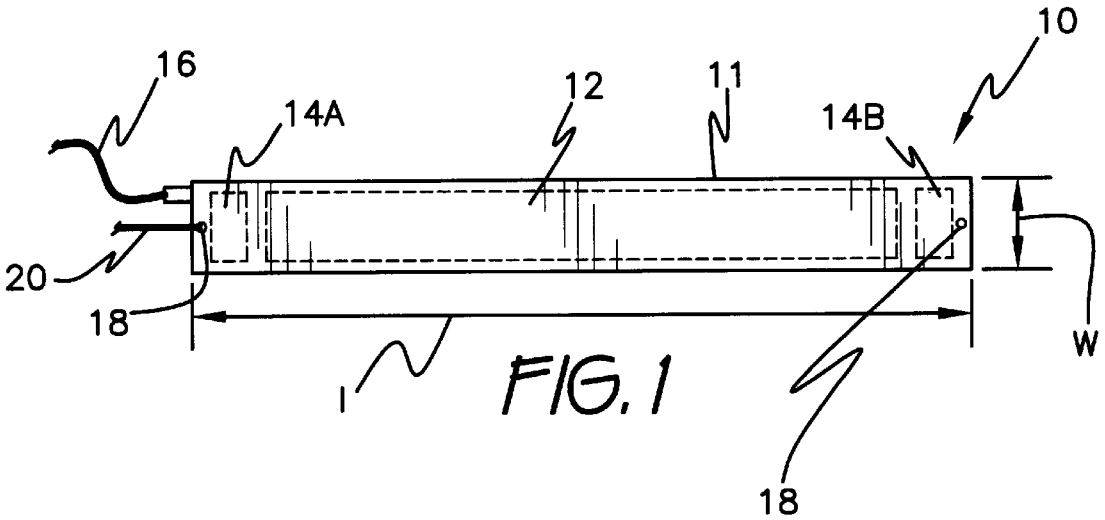
FIG. 1 is a top plan view of the sensor switch portion of the inventive alarm system.
Figure 2A:
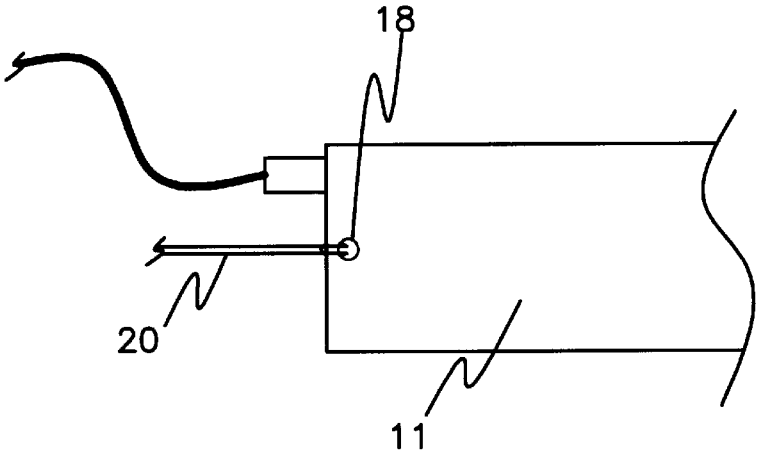
FIG. 2*a* detailed view of the attachment of rubber bands to the inventive sensor.
Figure 2B:
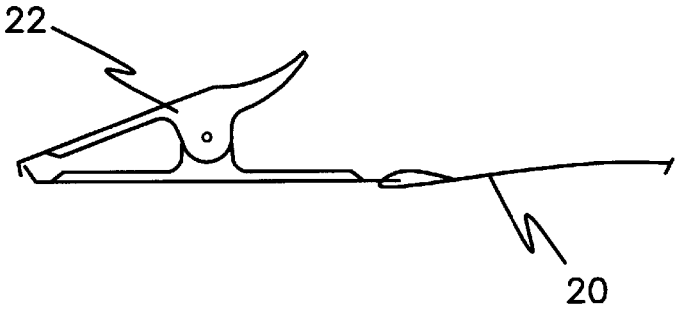
FIG. 2*b* is a detailed view of an attachment clip.

Referring first to FIG. 1, there is shown a top plan view of the sensor switch of the invention, reference number 10. Sensor switch assembly 10 *a* is soft, flexible assembly designed for easy installation across the width the mattress of a patient's bed. In the preferred embodiment, the overall length "1" of the sensor switch assembly 10 is between 30 and 32 inches, and the width "w" is approximately 3.5 inches. It should be obvious to those of skill in the art that the assembly could be built in a variety of widths and/or lengths to accommodate other operating environments or circumstances. Sensor switch assembly 10 is constructed using a polyester substrate 11. A central pressure-sensitive switch area 12 is designed to monitor the presence or absence of a patient at the center of a bed. In the preferred embodiment, central switch area 12 has a width of approximately 22 inches. Plural end pressure-sensitive switch areas 14*a*, 14*b* located at each end of sensor switch assembly 10 are designed to indicate the presence or absence of a patient at either edge of the mattress. An attachment cord 16 provides electrical interconnection between switch areas 12, 14*a*, 14*b* and a remote monitoring system (not shown). A pair of holes 18 allow for attaching anchoring ties to sensor switch assembly 10. Referring now also to FIGS. 2*a* and 2*b*, there are shown detailed drawings of the attachment mechanism of the inventive sensor assembly. In the preferred embodiment, rubber bands 20, each approximately 8–10 inches in length are looped through holes 18 in substrate 11. The other end of rubber bands 20 is attached to a spring clip 22. Clip 22 allows for securing the distal end of each rubber band 20 to the bed frame (not shown) or other suitable fastening point. The length of rubber bands 20 has been chosen to provide adequate tension in a typical hospital bed installation. It should also be obvious to those of skill in the art that different rubber band lengths, mounting hole numbers or locations, or fasteners other than those chosen for purposes of disclosure could be selected to function in a particular operating environment without departing from the true scope of the invention.

Figure 3:
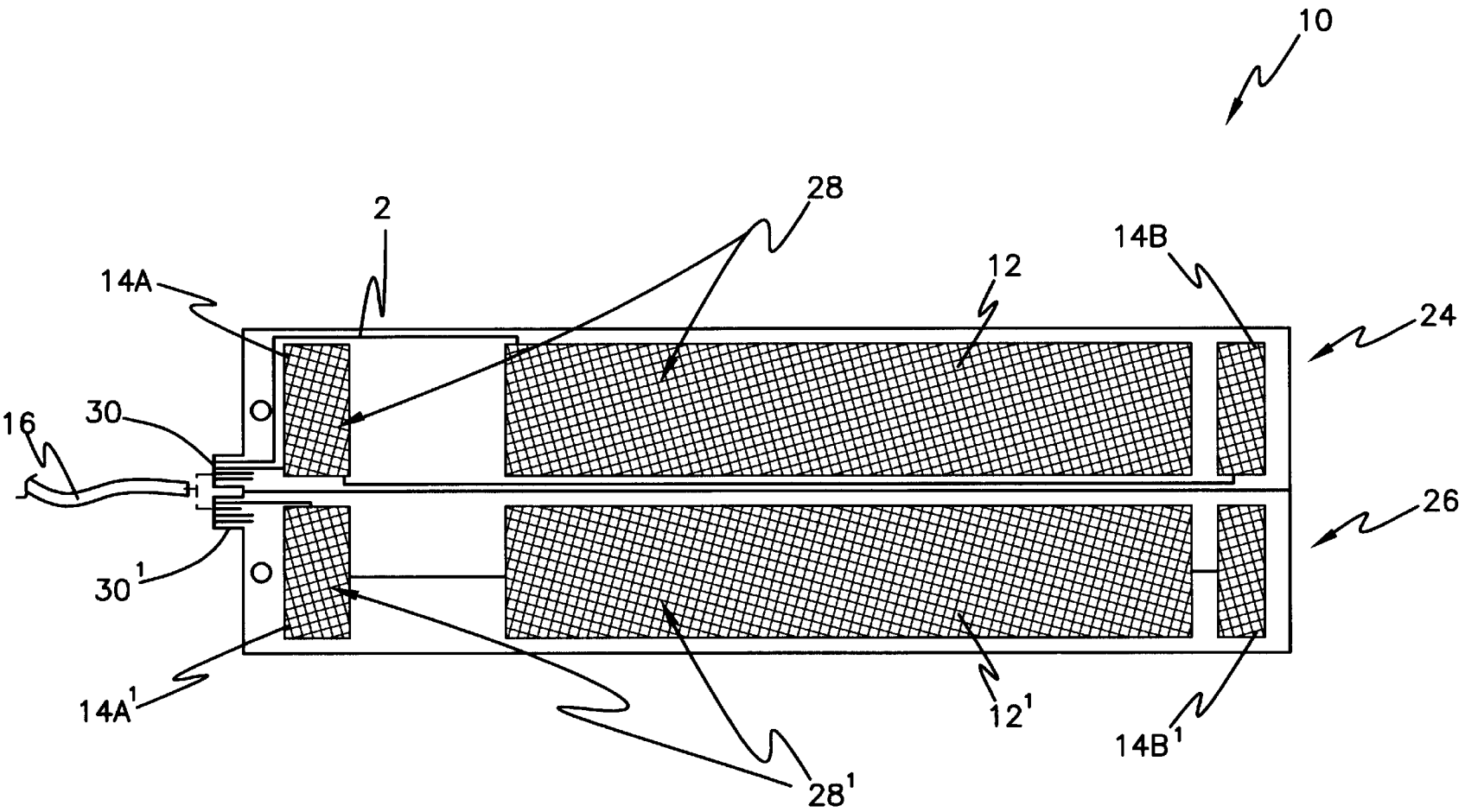
FIG. 3 is a schematic diagram of the top and bottom layers of the sensor before assembly.
Figure 4:
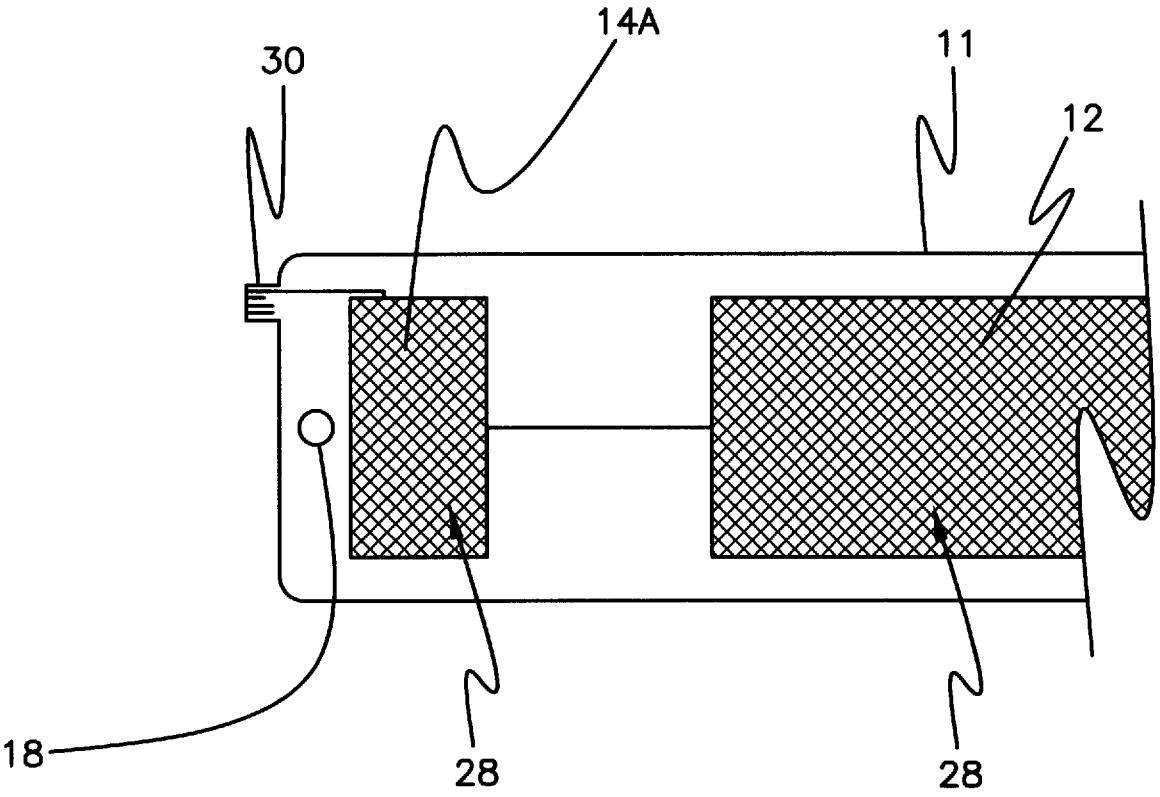
FIG. 4 is detailed drawing of the conductive ink pattern employed in the inventive sensor.
Figure 6:
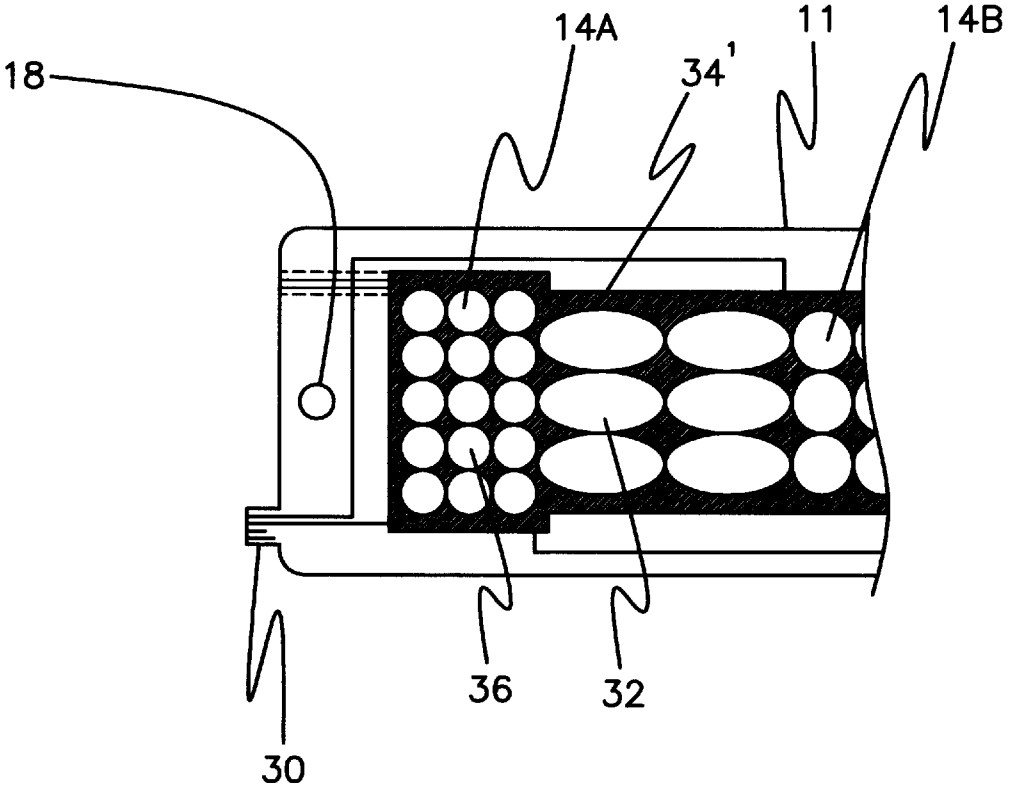
FIG. 6 is a schematic diagram of the sensor assembly showing the openings in the insulating layer through which the conductive ink may make contact.

Referring now to FIG. 3, there is shown a schematic view of sensor switch assembly 10 before assembly. Two substrates 24, 26 constructed from sheets of polyester or other suitable polymer film 24, 26, each nominally 0.007 inch thick and each also having the overall dimensions of sensor switch assembly 10. Films of between 0.005 and 0.010 inch thickness have been found suitable for use as substrates if suitable compensation is made in the size of the holes 36 (FIG. 6). Each film substrate 24, 26 is screen printed with conductive silver or silver/carbon ink 28 to form three distinct conductive areas 12, 14*a*, 14*b*, 12', 14*a*', 14*b*' on each substrate 24, 26, respectively. A suitable ink is catalog number E82-05 as supplied by Colonial, Inc. Switch areas 12', 14*a*', 14*b*' on polyester sheet 26 are printed as mirror images of switch areas 12, 14*a*, 14*b* on polyester sheet 24 respectively. The specific pattern of silver ink 28 deposited on sheets 24, 26 is shown in FIG. 4. It should be obvious that many other inking patterns could be employed to accomplish the function of the inventive switch sensor assembly 10. The pattern chosen for disclosure purposes has been optimized to provide maximum functionality and switch contact reliability for a minimum amount of silver ink 28. Silver ink 28 is also used to form electrical interconnections between switch areas 12, 14*a*, 14*b* and an electrical connector 30, 30$^1$ at one end of sensor switch assembly 10. DuPont part number 65801-004 has been found to be a suitable connector for this application. Switch areas 12', 14*a*', 14*b*' are all connected together also using silver ink 28. Electrical cable 16 is attached to connector 30, 30$^1$. A wide variety of connector devices and/or interfacing techniques well known in the art could also be used. The interface between connector 30, 30$^1$ and cord 16 is designed to be permanent i.e., cord 16 is not designed for removal from connector 30, 30$^1$ on switch sensor assembly 10 once the unit is assembled. Heat shrinkable tubing (not shown) surrounding the connector 30, 30$^1$ to cable 16 interface provides both mechanical strength and hermetic sealing for the electrical connection interface.

Figure 5:
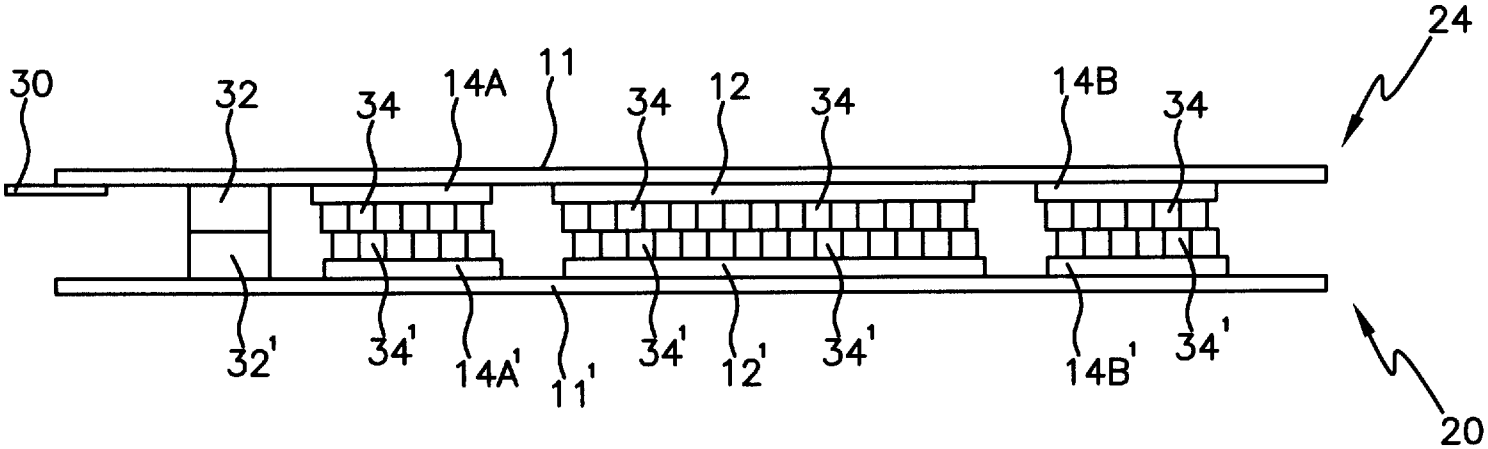
FIG. 5 is a detailed edge view of the printed conductive layer of the inventive sensor.

Referring now also to FIG. 5, there is shown a partial cross-sectional view of sensor switch assembly 10. Insulating layers 34, and optional insulating layer 34' are screen printed over switch areas 12, 14*a*, 14*b* and 12', 14*a*' 14*b*' respectively. Referring now also to FIG. 6, insulating layers 34, 34', are printed in a pattern having a series of openings 36 which will allow selective electrical contact through openings 36 between switch areas 12, 14*a*, 14*b* with corresponding switch areas 12', 14*a*', 14*b*' when sensor switch assembly 10 is compressed as is accomplished in typical use by the weight of a patient. FIG. 6 shows the patterns chosen for purposes of disclosure. It has been found that by controlling the size, number, and arrangement of the holes in both the end switching areas 14*a*, 14*b* that optimal sensor switch performance i.e., accurate closure as a patient moves from a central region of his or her bed to either edge of the bed, may be obtained. Suitable materials for printing insulating layers 34, 34' are screen-printable foam spacer materials such as catalog number Switchmark 2-7-2 supplied by Flexcon. The thickness of insulating layers 34, 34' and the geometry of the openings in the layer are used to adjust the sensitivity of the sensor. It has been found that for the edge sensing areas 14*a*, 14*b* to be actuated by a patient moving to the edge of the bed, these areas 14*a*, 14*b* must be less sensitive than the central sensing region 12 to minimize unwanted contact closure (i.e., false alarms) due to the more concentrated weight of an upright patient. Without the decreased sensitivity in regions 14*a*, 14*b*, the weight of a patients arm could possibly trigger the alarm.

Necessary electrical connections are made to connector 30, 30$^1$ and then polyester sheets 24, 26 and are sandwiched to form switch sensor assembly 10, the edges of sheets 24, 26 being sealed at their peripheries with an adhesive such as Switchmark 2-0-0-S supplied by Flexcon. The are many suitable screen-print adhesives well known to those of skill in the art which could be substituted. It has been found that by limiting adhesive penetration to only within approximately 0.070 inches of the conductive areas 12, 14*a*, 14*b* and avoiding placing adhesive between conductive switching areas 14*a*-12 and 12-14*b* respectively improves performance of sensor switch assembly 10. Air passages (not shown) are naturally formed in the interior regions of sensor assembly 10. It should also be noted that open areas 32 and 36 also function as air passages. It has been found that leaving openings (not shown) in the periphery of sensor assembly 10 in communication with these interior air passages provided a means for air to readily enter the sensor assembly after prolonged periods of storage or use. Certain operating environments or requirements may require a sealed sensor assembly 10. In these cases, all openings allowing are into or out of the interior of sensor assembly 10 may be sealed.

Figure 7:
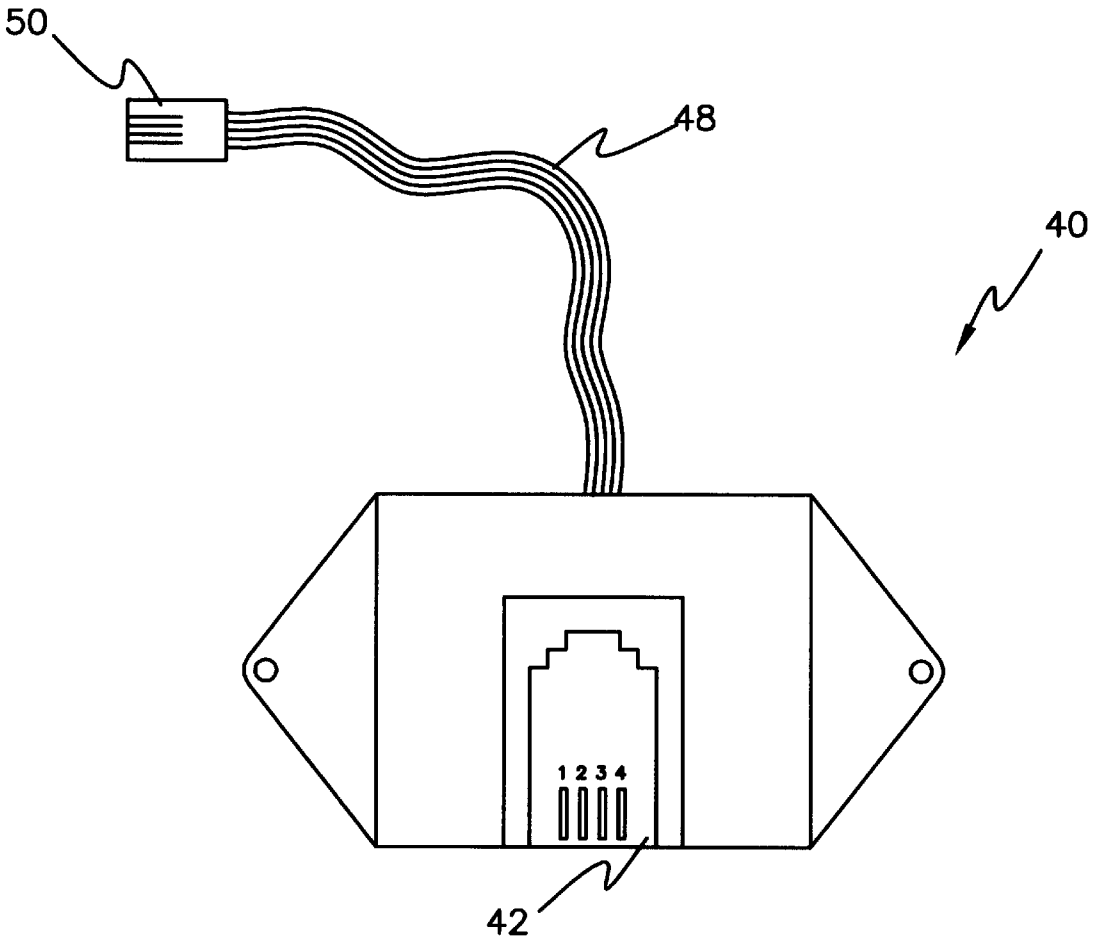
FIG. 7 is an end view of the converter/adapter showing the input connector and output cable and connector.

Sensor switch assembly 10 is designed to function as part of a novel bed-egress alarm system adapted to function with existing hospital patient monitoring/fall prevention systems. Referring now to FIG. 7, there is shown a side end view of one implementaion of a converter/adapter 40 showing the input connector 42 and output cable 48 and output connector 50. Cable 48 is typically terminated by an RJ11 crimp connector 50 well known in the telephony art. Other connectors may be used to meet a particular operating requirement. Cable 48 generally comprises four conductors, only three of which must be used. The forth conductor may be use as an optional ground connection when required. The inside sensing area 12 (FIG. 1) will appear at pin "1" of connector 42. The outside end-sensing switching areas 14*a*, 14*b* (FIG. 1) are provided with a common interface connection appearing at pin "2" of connector 42. There may be no connection to pin "3" of connector 42. When required, a forth conductor serving as a ground may appear at pin "3" of connector 42. Pin "4" of connector 42 is a common or ground connection.

Figure 8A:
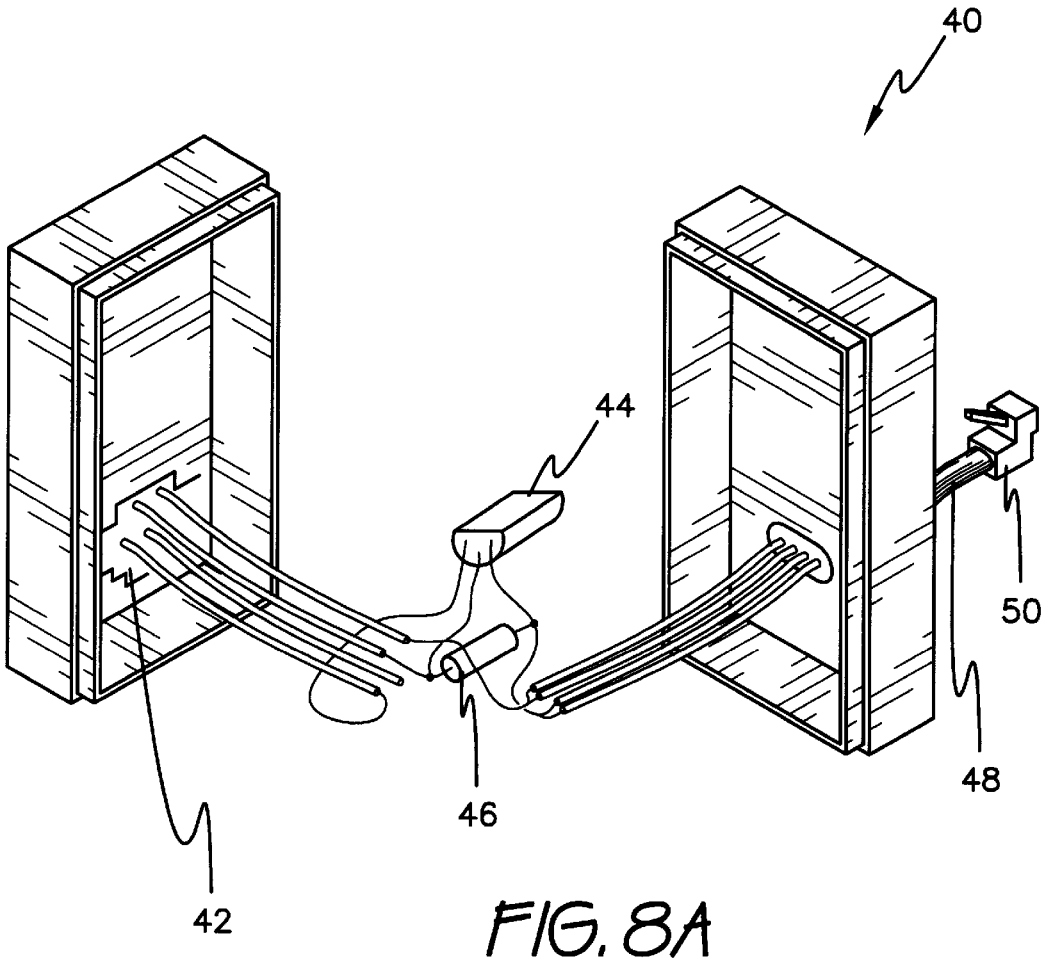
FIG. 8*a* as a exploded pictorial view of the convertor/adapter.
Figure 8B:
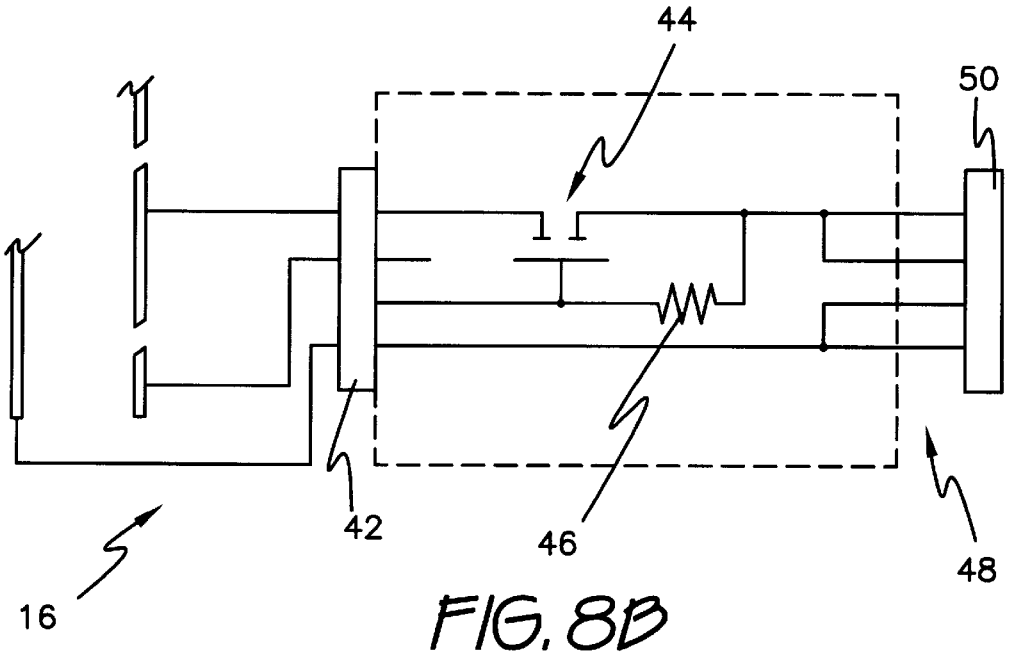
FIG. 8*b* is an electrical schematic diagram of the convertor/adapter.

Referring now to FIGS. 8*a* and 8*b*, there is shown an exploded, perspective view and an electrical schematic diagram respectively of an optional converter box 40 designed to easily interface the inventive sensor switch assembly 10 (FIG. 1) to a typical fall prevention alarm system (not shown). An input connector 42 designed to receive the RJ11 plug from sensor assembly 10. A field-effect transistor (FET) 44 is used to perform buffering and isolation function and to provide adequate drive current to the alarm or monitor system to which the inventive sensor 10 is to be attached. An output cable 48 is terminated with another RJ11 phone-style connector 50.

Figure 9:
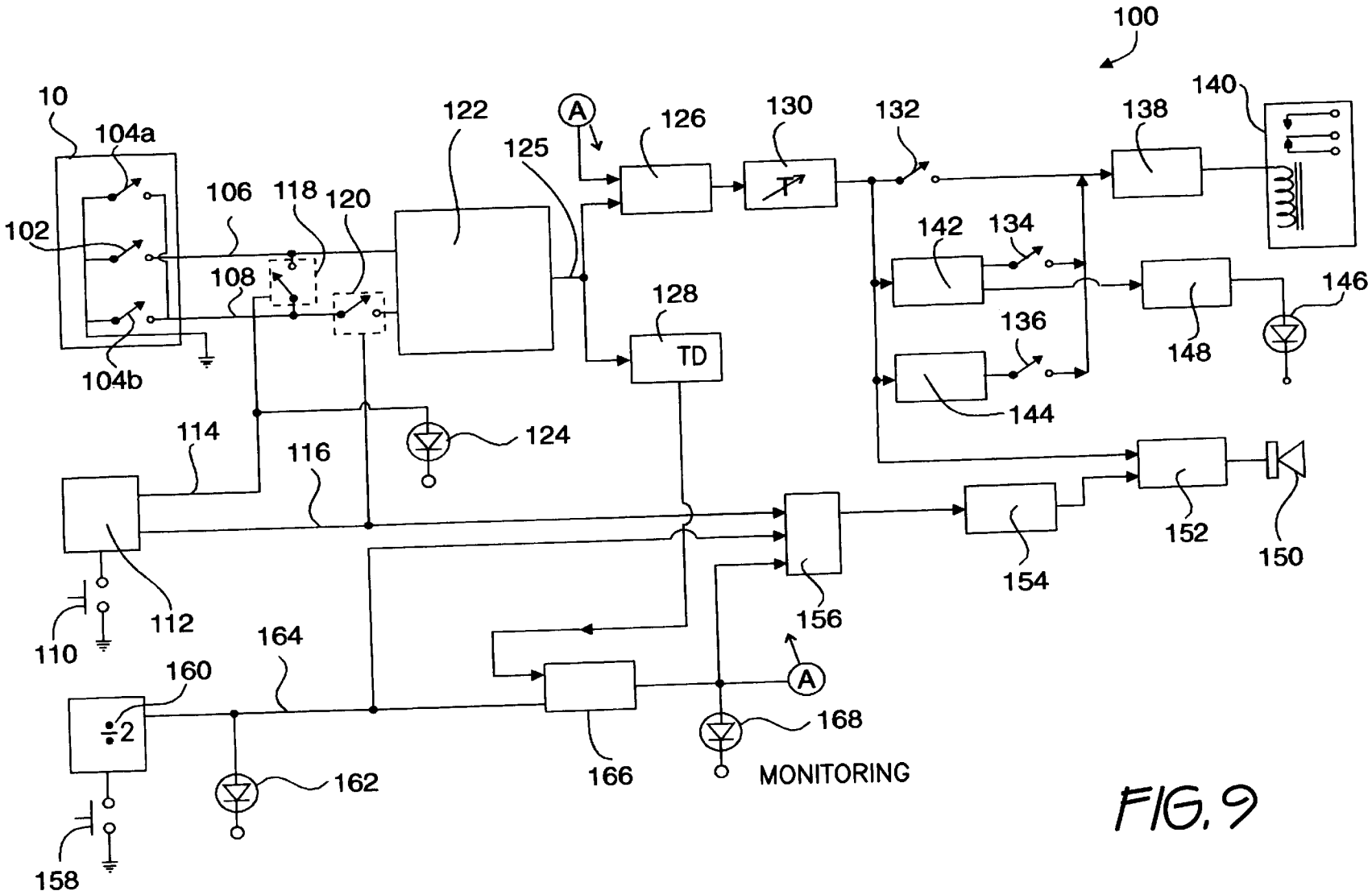
FIG. 9 is a schematic block diagram on the inventive monitor system.

The inventive sensor switch assembly 10 (FIG. 1) is adapted to work cooperatively with a dedicated monitor interface and control unit 100, shown schematically in FIG. 9. Central switch contact 102 and edge switch contacts 104*a*, 104*b* are connected to monitor 100 by lines 106 and 108 respectively. An operator-accessible push button switch 110 is used to toggle edge sense select circuit 112, a divide-by-two flip-flop, between one of two output states. In the first output state, monitor 100 is adapted to operate with the inventive sensor 10 fully utilizing its bed edge sensing capability. In the second output state, monitor 100 is configured to work as a conventional, single-output monitor. This single-output mode could be selected when a very active patient has a history of false alarms. Two output signals 114, 116 from edge sense select circuit 112 are each connected to a solid state switch 118, 120, respectively. Switches 118, 120 may be electromagnetic relays, (such as a reed relays), solid-state switches, or any variety of electrically isolated electronic switches well known to those of skill in the circuit design art. When edge sense select circuit 112 is in its first (turn-on) output state (i.e., edge sensing is activated), output 114 is low (inactive) while output 116 is high (active). This causes switch 118 to be open and switch 120 to be closed thereby routing sensor output signal 108 to a first input of edge sense override circuit 122. Sensor output signal 106 is always connected to a second input of edge sense override circuit 122. Note that when push button switch 110 is depressed once to toggle the output of edge sense select circuit 112, the levels of output signals 114 and 116 are reversed. In this mode, switch 118 is closed and sensor output signals 106, 108 are connected together and applied to an input of edge sense override circuit 122. Switch 120 is opened thus removing any signal from the other input to edge sense override circuit 122. An LED 124 is connected to output 114 and indicates when the edge sense mode is selected.

Regardless of the mode of operation selected by edge sense select push button 110, when switch contact 102, 104*a*, 104*b* is opened (i.e., a patient removes his or her weight from the central region of sensor 10), an output signal 125 is generated by edge sense override circuit 122. Signal 125 is applied to one input of an "OR" circuit 126 and to the input of time delay circuit 128. Time delay circuit 128 will be discussed in more detail hereinbelow. The output of the "OR" circuit 126 is applied to the input of a second time delay circuit 130—the TIME DELAY BEFORE ALARM circuit. Time delay circuit 130 is equipped with a slide switch (not shown) by which one of three different resistors (not shown) may be selected as the "R" element of an "RC" timing circuit. In the preferred embodiment time delays of approximately 1, 3, or 5 seconds are selectable. It should be obvious that other numbers of selectable times or time values could be provided to meet a particular operating requirement without departing from the scope and spirit of the invention. Time delay circuit 128 is provided to prevent false alarms caused by a patient momentarily shifting his or her weight off the central region of sensor 10. The required time delay may be selected on a patient-by-patient basis to insure that for any given patient's behavior that monitor 100 will perform optimally.

Assuming that a sensor contact 102 remains open or that contacts 104*a*, 104*b* close longer than the time delay select for time delay circuit 130, an output signal is then generated after the time delay 130 which is provided to one side of three normally open switches 132, 134, 136. Switches 132, 134, 136 function as output mode selection switches which provide compatibility with differing requirements of various nurse call systems. Assuming that only switch 132 is closed, the output signal from time delay 130 is provided directly to the input of relay driver 138. Absent an input signal, relay driver 138 normally provides drive to the coil of relay 140. This is a fail-safe mode of operation wherein the loss of voltage or power to monitor 100 will result in an alarm signal being generated. Upon application of an input signal, relay driver 138 removes voltage from the coil of relay 140. The contacts of relay 134 are connected in an appropriate manner to an external nurse call/patient alarm system (not shown). It should be obvious to those having skill in the art that a variety of devices could be used to implement the functions of relay 140 and that relay 140 could have any contact arrangement necessary to properly interface with an existing alarm or nurse call system.

An alternate output mode may be selected by opening switch 132 and closing switch 134. In this mode, the output signal of time delay circuit 130 is applied to a free-running oscillator circuit 142 which provides a pulsing signal to the input of relay driver 138. In this manner, the contacts of relay 140 continuously open and close when an alarm condition has been sensed by monitor 100.

A third output mode may be selected by opening both switches 132, 134 and closing switch 136. In this mode, the output signal from time delay circuit 130 is applied to the input of a one-shot circuit 144. The single-pulse output of one-shot 144 is applied to the input of relay driver 138 resulting in a single, momentary transition of the contacts of relay 140.

An "ALARM" LED 146 is connected to the output of "NAND" circuit 148. One input to "NAND" circuit 148 is connected to the output of time delay 130. Consequently, absent a signal at the second input of "NAND" 148, LED will be off. The second input to "NAND" 148 is, however, connected to the output of free-running oscillator 142. During an alarm state, LED 146 will blink in synchronism with the intermittent closure of relay 140.

As well as the relay output interface to a nurse call-type system and the visual indicator described hereinabove, monitor 100 is equipped with an audible alarm. An audible alert device 150 is connected to the output of "OR" circuit 152. A first input to "OR" circuit 152 is connected to the output of time delay 130 so that a local, audible alert is sounded whenever an alarm condition is generated. A second input to "OR" circuit 152 is connected to the output of a monostable timer circuit, 154. In the preferred embodiment, timer 154 is adjusted to produce a 0.1 second signal which results in a short "beep" from audible alert 150. The input to timer 150 is connected to the output of event detector circuit 156. Event detector circuit 156 monitors several conditions within monitor 100 and provides a short (0.1 second) sonic burst from sonic alert 150 to signal several important conditions occurring during the setting or resetting of monitor 100 as will be described in detail hereinbelow.

Several of the innovative features of monitor 100 are found in its setting and resetting circuitry. When a patient is first entering the bed, it is important that spurious alarm signal not be generated. This is accomplished in the inventive monitor through the use of a multi-purpose push button switch 158, the "HOLD" switch. Hold switch 158 is connected between the output of time delay 128 and divide-by-two circuit 160 which allows to operate as a toggle, i.e., the output changes from high (active) to low (inactive) and vice versa upon alternate depressions of switch 158. While time delay 128 is "active" i.e., is performing its timing cycle, switch HOLD 158 is inoperable (i.e., no action results from depressing the switch). The means that the bed egress alarm can not be armed during the approximately fifteen seconds after the patient has first entered the bed and switch 102, 104*a*, or 104*b* are first closed or opened, respectively. If, as the patient enters the bed and the 15-second time delay starts, and the patient rises from the bed, even momentarily, the 15-second timeout is reset to zero and the timing cycle restarted. This is one way in which spurious, false alarms are prevented. Both divide-by-two circuit 160 and edge sense select flip-flop 112 are provided with a power on reset signal (not shown) which forces both circuits to a predetermined state upon the application of power to monitor 100.

When power is first applied to monitor 100, divide-by-two circuit 160 is forced into a state where its output, line 164 is low. When line 164 is low, "HOLD" LED 162 connected to the output of divide-by-two circuit 160, is illuminated. "HOLD" LED 162 serves to indicate to an attendant that the bed egress alarm system is disarmed. Line 164 from flip-flop 160 is connected to a first input of NAND 166. The second input to NAND 166 is connected to the output of edge sense override circuit 122. "MONITORING" LED 168 which is connected to the output of NAND 166, indicates to an attendant that the bed egress alarm system is armed and in its normal monitoring state. The output of NAND 166 is also connected to the second input of OR 126. This insures that an alarm signal can not be generate by time delay 130 in cooperation with the other circuitry described hereinabove until the system is armed and in the monitoring mode of operation. Finally, the output of NAND 166 is also connected to the input of divide-by-two circuit 160 to automatically arm the monitoring systems after the 15-second timeout of time delay 128. The output of divide-by-two circuit 160 is provided as a third input to event monitor 156. A change of the output state of flip-flip 160 generates an approximately 0.1 second audible sound to let an attendant know that the monitoring system is being either armed or disarmed, even if the "HOLD" and "MONITORING" LEDS are out of view of the attendant.

Once monitoring system 100 is armed and monitoring, one of two things may happen. First, as a patient moves towards the edge of the bed, he or she will close contact 104*a* or 104*b* and, after the selected time delay set by time delay 130, the alarm will be sounded. Second, an attendant will come to help the patient out of bed after first depressing HOLD switch 158. The system will be disarmed and no additional alarm signals will be generated.

In alternate embodiments, the sensor 10 (FIG. 1) may be reconfigured and adapted to work in a chair seat. While the weight of a seated patient is centered towards the rear of the chair, a primary sensing region contact similar to central region 12 (FIG. 1) will remain closed. As the seated patient shifts his or her weight towards the front of the chair in preparation for standing, a secondary switch area similar to edge-sense regions 14*a*, 14*b* (FIG. 1) is closed. The early egress feature of alarm system 100 will then function identically as when connected to the bed sensor 10 described in detail hereinabove.

Since other modifications and changes varied to fit a particular operating requirements and environment will be apparent to those skilled in the art, the invention is not considered limited to the example chosen for purposes of disclosure, and covers all changes and modifications which do not constitute a departure from the true spirit and scope of the invention.

Having thus described the invention, what is desired to be protected by Letters Patent is presented in the subsequent appended claims.

What is claimed is:

1. An early warning bed egress alarm system, comprising:

sensing means for being placed atop the mattress of a patient bed, said sensing means comprising a pressure responsive switch having a top substrate having a top surface, a bottom surface, a width and a length, a bottom substrate having a top surface, a bottom surface, a width and a length, said width of said bottom substrate being essentially identical to said width of said top substrate and said length of said bottom substrate being essentially the same as said length of said top substrate, a first plurality of electrically conductive areas disposed on said bottom surface of said top substrate, a second plurality of electrically conductive areas disposed on said top surface of said bottom substrate, said second plurality of electrically conductive areas corresponding to said first plurality of electrically conductive areas, an insulating layer disposed proximate at least one of said first plurality of electrically conductive areas, and said second plurality of electrically conducting areas, said insulating layer having a series of openings allowing selective electrical connection to said plurality of electrically conductive areas, and an electrical conductor connected to at least one of said first plurality of electrically conductive areas and to at least one of said second plurality of electrically conductive areas, said sensing means being independently responsive to a patient's presence at the center of said mattress and near the edge of said mattress;

wherein said pressure responsive switch has two end sensor portions for sensing the pressure on the edge of the bed and a central sensor portion disposed between said two end sensor portions for sensing the pressure on the center of the bed, the two end sensor portions and the central sensor portion are spaced apart evenly and are connected via a conductor, and wherein said series of openings allowing selective electrical connection to said plurality of electrically conductive areas comprises a first group of said openings disposed at one said end portion, a second group of said openings disposed at the other said end portion, and a third group of said openings disposed at said central section, said openings of said first group of said openings and said openings of said second group of said openings differing from said holes of said third group of said openings in dimension such that differing degrees of pressure will activate said two end portions with relation to said central portion of said pressure responsive switch;

monitoring means operatively connected to said sensing means, said monitoring means being adapted to detect movement of a patient from the center of said mattress to an edge of said mattress; and signaling means operatively connected to said monitoring means for providing a signal when a patient moves from the center of said mattress to an edge of said mattress.

2. The early warning bed egress alarm system as recited in claim 1, wherein said signaling means further comprises interface means for connecting said signaling means to a nurse call system.

3. The early warning bed egress alarm system as recited in claim 2, wherein said interface means for connecting said signaling means to a nurse call system provided at least one, preselected output mode from the group of continuous contact closure; intermittent contact closure; or single, short-duration contact closure.

4. The early warning bed egress alarm system as recited in claim 1, wherein said signaling means comprises at least one from the group of visual indicating means and audible signaling means.

5. The early warning bed egress alarm system as recited in claim 1, wherein said monitoring means comprises time delay means, said time delay means having a preselected time delay value whereby a signal from said signaling means is prevented for the duration of said time delay value.

6. The early warning bed egress alarm system as recited in claim 5, further comprising means for altering said preselected time delay value.

7. The early warning bed egress alarm system as recited in claim 6, wherein said means for altering said preselected time delay value further comprises fault-sensitive fail-safe means for insuring a signal from said signaling means upon failure of said means for altering said time delay value.

8. The early warning bed egress alarm system as recited in claim 1, wherein said monitoring means comprises an armed, active mode and a reset mode of operation, said armed, active mode and said reset mode being alternately selectable by a single operator control.

9. The early warning bed egress alarm system as recited in claim 1, wherein said first substrate and said second substrate are flexible, said flexible substrates comprising polyester having thickness in the range of 0.005 to 0.010 inch, said first plurality and second plurality of electrically conductive areas are formed from a silver and carbon conductive ink, and said insulating layer comprises non-conductive spacer material.

10. The early warning bed egress alarm system as recited in claim 1, wherein said process of forming is fabricated by screen printing and wherein said insulating layer is screen printed.

* * * * *